US008884504B2

(12) United States Patent
Hanashi et al.

(10) Patent No.: US 8,884,504 B2
(45) Date of Patent: Nov. 11, 2014

(54) SPARK PLUG FOR INTERNAL COMBUSTION ENGINES AND MOUNTING STRUCTURE FOR THE SPARK PLUG

(71) Applicant: Denso Corporation, Kariya (JP)

(72) Inventors: Ken Hanashi, Handa (JP); Nobuo Abe, Yokkaichi (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 14/355,817

(22) PCT Filed: Oct. 31, 2012

(86) PCT No.: PCT/JP2012/078180

§ 371 (c)(1),
(2), (4) Date: May 1, 2014

(87) PCT Pub. No.: WO2013/065742

PCT Pub. Date: May 10, 2013

(65) Prior Publication Data

US 2014/0265816 A1 Sep. 18, 2014

(30) Foreign Application Priority Data

Nov. 1, 2011 (JP) ..... 2011-240353

(51) Int. Cl.
*H01T 13/20* (2006.01)

(52) U.S. Cl.
CPC ..... *H01T 13/20* (2013.01)
USPC ..... 313/141; 313/142

(58) Field of Classification Search
CPC ..... H01T 13/32; H01T 13/20
USPC ..... 313/118–145
See application file for complete search history.

(56) References Cited

U.S. PATENT DOCUMENTS 5,373,214 A * 12/1994 McCready ..... 313/142
5,929,556 A 7/1999 Matsubara et al.

(Continued)

FOREIGN PATENT DOCUMENTS

JP 3140006 12/2000
JP 3272615 1/2002

(Continued)

OTHER PUBLICATIONS

International Report on Patentability (10 pages) for PCT/JP2012/078180 mailed May 15, 2014.

(Continued)

*Primary Examiner* — Anne Hines
(74) *Attorney, Agent, or Firm* — Nixon & Vanderhye PC

(57) ABSTRACT

A spark plug for an internal combustion engine is provided, which includes a housing, an insulation porcelain, a center electrode and a ground electrode. At least one of a tip portion of the center electrode and an opposing portion of the ground electrode is provided with a projection portion. At least one of the projection portions has a cross section perpendicular to the axial direction of the plug, the cross section having a minimum curvature radius portion and being in a specific shape that satisfies a predetermined requirement. The requirement is that, when a first straight line, a first line segment and a second straight line are provided, and when the cross section is divided into a first region and a second region by the second straight line, the second region has an area larger than the area of the first region.

12 Claims, 15 Drawing Sheets

(56) References Cited

U.S. PATENT DOCUMENTS

| | | | | |
|---|---|---|---|---|
| 6,166,480 | A * | 12/2000 | Ishida et al. | 313/141 |
| 6,229,253 | B1 | 5/2001 | Iwata et al. | |
| 2003/0155849 | A1 | 8/2003 | Hori | |
| 2007/0114902 | A1 * | 5/2007 | Suzuki | 313/141 |

FOREIGN PATENT DOCUMENTS

| | | |
|---|---|---|
| JP | 2003-317896 | 11/2003 |
| JP | 2008-303840 | 12/2008 |
| JP | 2009-252525 | 10/2009 |
| WO | WO 2010/038467 | 4/2010 |

OTHER PUBLICATIONS

International Search Report for PCT/JP2012/078180 mailed Feb. 5, 2013.

Written Opinion of the International Searching Authority mailed Feb. 5, 2013.

* cited by examiner (A)

(B)

(A)

(B)

SPARK PLUG FOR INTERNAL COMBUSTION ENGINES AND MOUNTING STRUCTURE FOR THE SPARK PLUG

CROSS-REFERENCE TO RELATED APPLICATION

This application is the U.S. national phase of International Application No. PCT/JP2012/078180 filed 31 Oct. 2012 which designated the U.S. and claims priority to JP Application No. 2011-240353 filed Nov. 1, 2011, the entire contents of each of which are hereby incorporated by reference.

TECHNICAL FIELD

The present invention relates to a spark plug for an internal combustion engine and a mounting structure for the spark plug, the spark plug being used for passenger cars, automatic two-wheeled vehicles, cogeneration systems, gas pressure pumps or the like.

BACKGROUND TECHNIQUE

FIG. 1 shows a conventionally used spark plug 9 for an internal combustion engine. For example, the spark plug 9 is used as a means for igniting an air-fuel mixture introduced into a combustion chamber of an internal combustion engine such as of a passenger car.

The spark plug 9 includes a center electrode 94 and a ground electrode 95. The ground electrode 95 has an end fixed to a housing 92, while being bent to bring the other end to a position facing the center electrode 94.

In the ground electrode 95, a projection portion 96 is arranged, being projected toward a spark discharge gap 911. The projection portion 96 has an opposing face 960 that faces the center electrode 94. As shown in FIG. 2 by (A) and (B), a discharge is caused in the spark discharge gap 911 and the air-fuel mixture is ignited by the discharge. A reference E in the figure indicates a discharge spark formed by the discharge, a reference F indicates a flow of the air-fuel mixture and a reference I indicates a flame (see Patent Document 1).

Patent Document 2 discloses a spark plug that includes a ground electrode without having the projection portion 96.

PRIOR ART DOCUMENTS

Patent Documents

[Patent Document 1] JP-A-2003-317896
[Patent Document 2] JP-A-2009-252525

SUMMARY OF THE INVENTION

Problems to be Solved by the Invention

However, recently, various lean-burn internal combustion engines have been developed to enhance fuel efficiency. In lean burn, the flow speed of the air-fuel mixture in the combustion chamber is required to be high in order to retain ignitability to the air-fuel mixture. Therefore, when the spark plug 9 as shown in Patent Document 1 is used, the discharge spark E tends to be expanded and cut according to the increase of the flow speed of the air-fuel mixture, as shown in FIG. 2 by (C), before the air-fuel mixture is heated by the discharge spark E in the spark discharge gap 911. When the discharge spark E is extinguished, a phenomenon of causing a discharge for the second time (hereinafter this is referred to re-discharge) occurs and this is repeated. The discharge spark E constantly drifts in a constant direction, i.e. downstream, due to the gas flow to repeat re-discharges in a downstream-side edge portion of the projection portion 96. Thus, this portion tends to be disproportionately worn out (hereinafter this is referred to as disproportionate wear). As a result, the life of the spark plug is problematically shortened.

On the other hand, generally, the life of a spark plug may be lengthened by increasing the diameter of the projection portion 96 and enhancing wear resistance.

However, in this case, the opposing face 960 of the projection portion 96 is enlarged and therefore the opposing face 960 may draw heat from the flame I in a period when flame grows and may inhibit growth of the flame I (hereinafter this is referred to as quenching action). As a result, ignitability of the spark plug may be impaired.

In the spark plug described in Patent Document 2, the ground electrode is ensured to be in a shape in which the volume on the downstream side with reference to the flow of the air-fuel mixture is ensured to be larger than the volume on the upstream side. However, in the absence of a projection portion, the quenching action tends to be accelerated, which is disadvantageous in enhancing ignitability. In the spark plug described in Patent Document 2, the ground electrode does not have a projection portion but this does not solve the problem of wear in the projection portion mentioned above.

It is thus desired to provide a spark plug for an internal combustion engine and a mounting structure for the spark plug, with which ignitability and life of the plug are enhanced, while quenching action is minimized.

Means for Solving the Problems

An aspect of the present disclosure lies in a spark plug for an internal combustion engine, the spark plug including a cylindrical housing, a cylindrical insulation porcelain held inside the housing, a center electrode held inside the insulation porcelain, with a tip portion thereof being projected, and a ground electrode connected to the housing and having an opposing portion opposed to the center electrode in an axial direction of the plug to form a spark discharge gap between the center electrode and the ground electrode, the spark plug being characterized in that: at least one of the tip portion of the center electrode and the opposing portion of the ground electrode has a projection portion projected toward the spark discharge gap; and at least one of the projection portions has a cross section perpendicular to the axial direction of the plug, the cross section including a minimum curvature radius portion having a smallest curvature radius in a contour of the cross section, and is in a specific shape that meets the following requirement, the requirement being that, when a first straight line is supposed to connect between the minimum curvature radius portion and a geometric centroid in the cross section, a first line segment is supposed to connect between two intersections at which the first straight line intersects the contour of the cross section, and a second straight line is supposed to be perpendicular to the first line segment at a midpoint in the first line segment, and when the cross section is divided by the second straight line into a first region that includes the minimum curvature radius portion and a second region that does not include the minimum curvature radius portion, the second region has an area larger than an area of the first region.

Another aspect lies in a mounting structure for a spark plug, in which the spark plug set forth in the above is mounted to an internal combustion engine, the mounting structure being characterized in that the projection portion located in a combustion chamber is arranged so that the first region is located upstream of the second region with respect to a flow of an air-fuel mixture supplied to the combustion chamber.

Advantageous Effects

In the spark plug, at least one of the projection portions has a cross section perpendicular to the axial direction of the plug and the cross section is formed into the specific shape. Specifically, in the cross section, the area of the second region is ensured to be made larger than the area of the first region. In mounting the spark plug to the combustion chamber of an internal combustion engine, the spark plug is arranged so that the first region of the projection portion is located upstream of the second region with respect to the flow of an air-fuel mixture in the combustion chamber. Thus, the life of the spark plug can be lengthened. Specifically, with the above arrangement, the second region having a larger area is located downstream in the flow in the projection portion.

Accordingly, when re-discharge is repeatedly caused in the edge portion on the downstream side in the projection portion, the larger area can minimize the expansion of the range of wear in the projection portion due to the re-discharges. Thus, disproportionate wear in the projection portion is minimized and thus wear resistance is enhanced. As a result, the life of the spark plug is enhanced.

With the above arrangement, the minimum curvature radius portion in the first region is arranged on an upstream side. Electric field is most easily concentrated in the vicinity of the minimum curvature radius portion and thus the minimum curvature radius portion is likely to serve as a start point of discharge. Accordingly, by arranging the minimum curvature radius portion on the upstream side, an initial spark discharge is obtained upstream in the projection portion, and time is guaranteed before the spark discharge drifts downstream and is blown out by the air-fuel mixture. Thus, an ignition opportunity for the flame (i.e., the opportunity for the ignition) is well ensured. As a result, ignitability of the spark plug is enhanced.

The foregoing configuration is realized by forming the cross section of at least one of the projection portions into the specific shape. Thus, quenching action is suppressed without having to particularly increasing the diameter of the projection portion. As a result, ignitability of the park plug is prevented from being impaired.

As described above, the present disclosure can provide a spark plug for an internal combustion engine, the spark plug being able to enhance ignitability and life of the plug, while being able to suppress quenching action, and can provide a mounting structure for the spark plug.

MODES FOR IMPLEMENTING THE INVENTION

Hereinafter are described several embodiments of a spark plug for an internal combustion engine and a mounting structure for the spark plug, according to the present invention.

The spark plug for an internal combustion engine may be used as an igniting means for an internal combustion engine such as of passenger cars, automatic two-wheeled vehicles, cogeneration systems, or gas pressure pumps.

In the following description, a side of the spark plug, which is inserted into the combustion chamber of an internal combustion engine, is referred to as a tip side, and a side opposite to the tip side is referred to as a base side.

First Embodiment

Referring to FIGS. 3 to 8, a spark plug of an embodiment is described.

Figure 3:
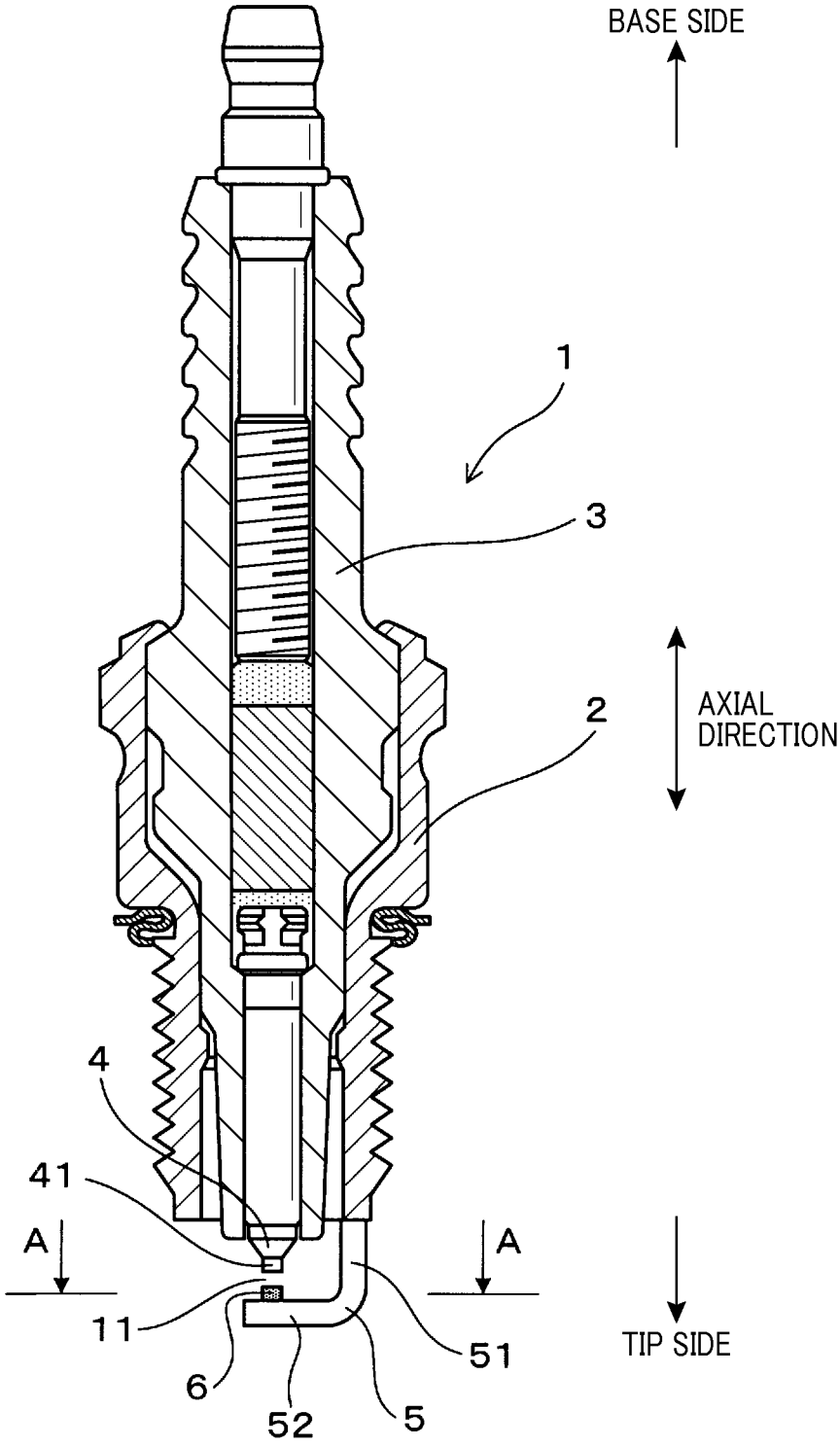
FIG. 3 is an explanatory view illustrating a partial cross section of a spark plug, according to a first embodiment.

As shown in FIG. 3, a spark plug 1 of the present embodiment includes: a cylindrical housing 2; a cylindrical insulation porcelain 3 held inside the housing 2; a center electrode 4 held inside the insulation porcelain 3 such that a tip portion is projected; and a ground electrode 5 connected to the housing 2 and having an opposing portion 52 that faces the center electrode 4 in an axial direction of the plug (longitudinal direction of the spark plug 1: see FIG. 3) to form a spark discharge gap 11 between the center electrode 4 and the ground electrode 5.

In the opposing portion 52 of the ground electrode 5, a projection portion 6 is arranged being projected toward the spark discharge gap 11.

Figure 4:
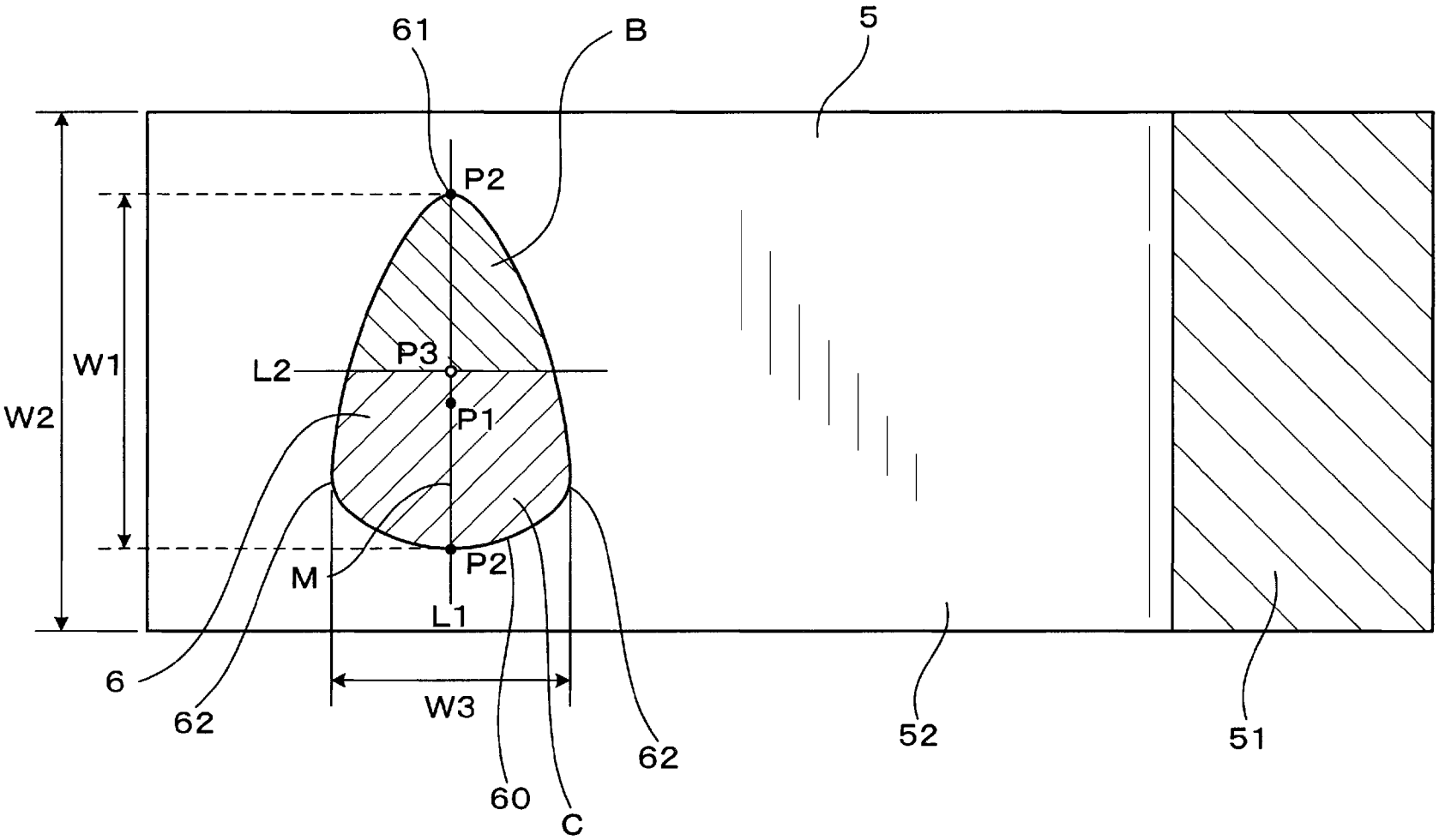
FIG. 4 is a cross sectional view taken along a line A-A of FIG. 3.

As shown in FIG. 4, the projection portion 6 is in a specific shape. The projection portion 6 has a cross section perpendicular to the axial direction of the plug, and the cross section has a contour 60 that includes a minimum curvature radius portion 61 having a minimum curvature radius in the contour and meets the following requirement. The requirement is defined as follows. Specifically, as shown in FIG. 4, first, a first straight line L1 is supposed to connect the minimum curvature radius portion 61 and a geometric centroid P1 in the cross section. Then, a first line segment M is supposed to connect between two intersections P2 at which the first straight line L1 intersects the contour 60 of the cross section. Then, a second straight line L2 is supposed to extend at right angle to the first line segment M, passing through a midpoint P3 of the first line segment M. Then, the cross section is divided by the second straight line L2 into a first region B that includes the minimum curvature radius portion 61 and a second region C that does not include the minimum curvature radius portion 61. In this case, the area of the second region C is larger than that of the first region B.

Figure 5:
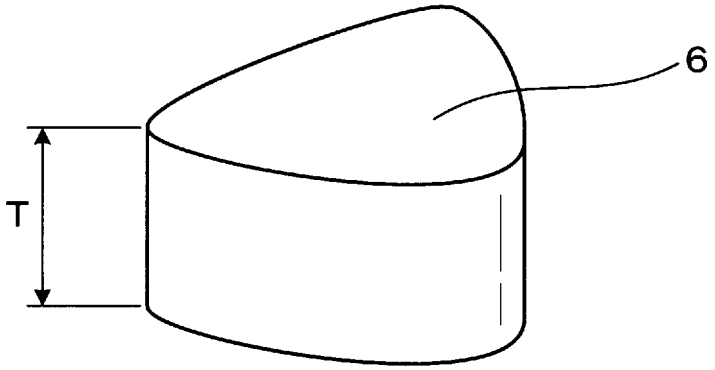
FIG. 5 is an explanatory view through a perspective of a projection in a specific shape, according to the first embodiment.

Further, the projection portion 6 is arranged such that the first straight line L1 will be perpendicular to an extending direction of the opposing portion 52 (broken line L5 indicated in FIG. 7) of the ground electrode 5. The projection portion 6 is formed such that an overall length W1 thereof coinciding with the first straight line L1 will be smaller than a width W2 of the opposing portion 52, the width W2 being perpendicular to the extending direction of the opposing portion 52. As shown in FIG. 5, the projection portion 6 is a pillar-shaped body having the cross section that meets the above specific shape. The projection portion 6 has a thickness T in the axial direction of the plug.

As shown in FIG. 4, the contour 60 of the cross section of the projection portion 60 is line symmetric with reference to the first straight line L1. The width of the contour 60 in the direction of the second straight line L2 gradually increases from the minimum curvature radius portion 61 (intersection P2 on the first region B side) toward the second region C to thereby form maximum width portions 62 in the second region C. Also, in the cross section, the contour 60 is tucked starting from the maximum width portions 62 toward the intersection P2 on the second region C side. The maximum width portions 62 each have the smallest curvature radius in the contour 60 of the second region C.

In the spark plug 1 of the present embodiment, the diameter of the housing 2 is 10 mm and the thickness at a tip portion of the housing 2 is 1.4 mm. The overall length W1 of the projection portion 6 along the first straight line L1 is 0.88 mm, a width W3 (see FIG. 5) that is perpendicular to both the direction coinciding with the first straight line L1 and the axial direction of the plug is 0.88 mm, and the thickness T of the projection portion 6 is 0.8 mm.

Further, the minimum curvature radius portion 61 in the first region B of the projection portion 6 has a curvature radius R1 of 0.1, while each maximum width portion 62 in the second region C has a curvature radius R2 of 0.2. The width W2 of the opposing portion 52 of the ground electrode 5 is 2.6 mm.

The center electrode 4 has a tip portion which is axially projected from an end of the insulation porcelain 3 by 1.5 mm. The size of the spark discharge gap 11 is 0.8 mm.

As shown in FIG. 3, the ground electrode 5 includes: a vertical portion 51 vertically provided on the tip side, with its one end being fixed to the tip portion of the housing 2; and the opposing portion 52 provided, being crooked, from the other end of the vertical portion 51 so as to face the center electrode 4 in the axial direction of the plug.

In the present embodiment, the projection portion 6 shown in FIG. 5 is arranged on a surface of the opposing portion 52, the surface being opposed to the center electrode 4.

The projection portion 6 is configured by a noble metal chip. More specifically, the projection portion 6 of the present embodiment is configured such as by a platinum alloy. In the present embodiment, the noble metal chip is bonded by welding to the opposing portion 52 of the ground electrode 5, so that the noble metal chip configures the projection portion 6.

The base material of the housing 2 and the ground electrode 5 (portions other than the projection portion 6) is a nickel alloy.

In the present embodiment, the tip portion of the center electrode 4 is configured by a substantially pillar-shaped projection portion 41 formed of a noble metal chip. For example, this noble metal chip may be configured by an iridium alloy.

The spark plug 1 of the present embodiment is used for an internal combustion engine of a vehicle, such as a passenger car.

Figure 6:
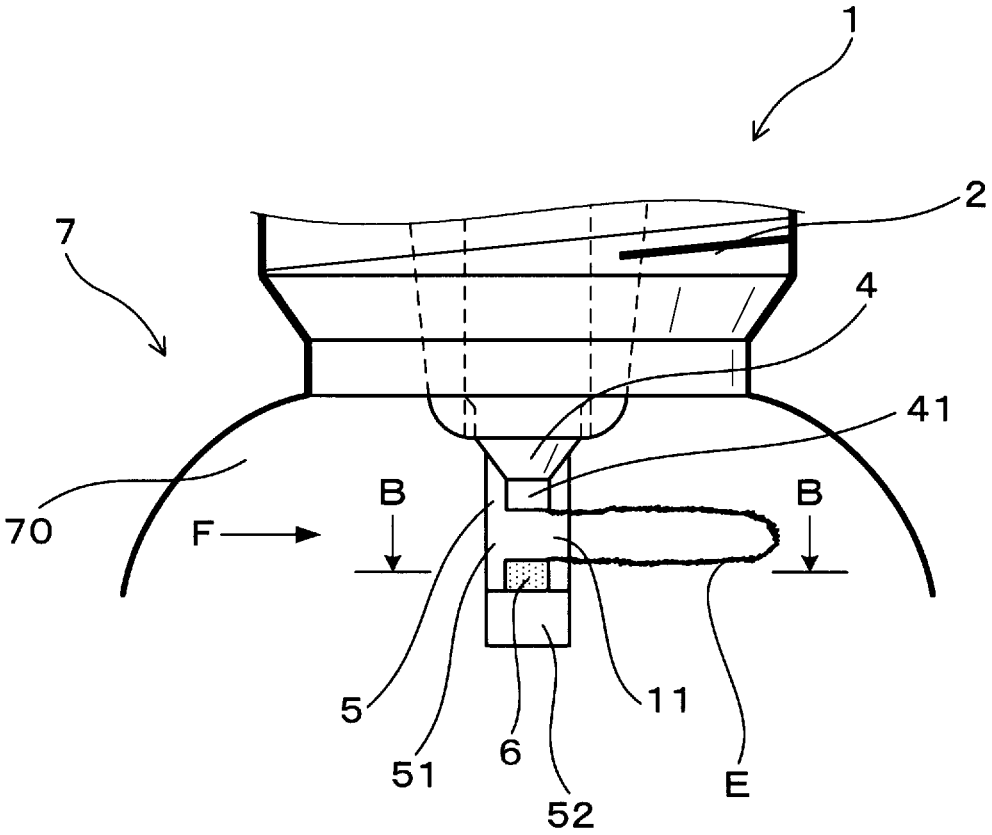
FIG. 6 is an explanatory view illustrating a state where the spark plug of the first embodiment is mounted into a combustion chamber.
Figure 7:
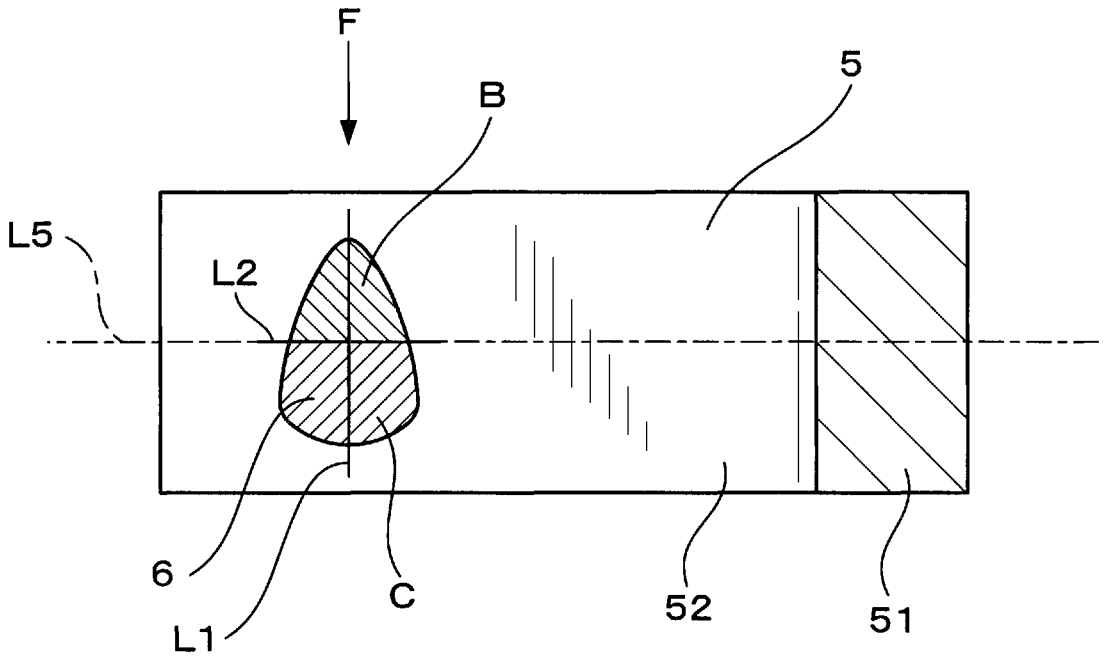
FIG. 7 is a cross-sectional view taken along a line B-B of FIG. 6.

Referring to FIGS. 6 and 7, hereinafter is described a mounting structure in which the spark plug 1 of the present embodiment is mounted to an internal combustion engine 7.

In mounting the spark plug 1 to the internal combustion engine 7, a known technique (e.g., JP-A-H11-324878 or JP-A-H11-351115) is used. Specifically, the spark plug 1 is mounted to the internal combustion engine 7 by adjusting the position of the ground electrode 5 with respect to the direction of a flow F of an air-fuel mixture in a combustion chamber 70.

Specifically, as shown in FIGS. 6 and 7, the spark plug 1 is mounted to the internal combustion engine 7 by performing adjustment such that the extending direction of the opposing portion 52 of the ground electrode 5 (broken line L5 indicated in FIG. 7) will be perpendicular to the direction of the flow F. In other words, the spark plug 1 is mounted to the internal combustion engine 7 so that the vertical portion 51 of the ground electrode 5 will not block the flow F. Further, as shown in FIG. 7, the projection portion 6 is arranged in the combustion chamber 70 such that the first region B is ensured to be located upstream of the second region C with respect to the flow F of the air-fuel mixture supplied to the combustion chamber 70.

Figure 8:
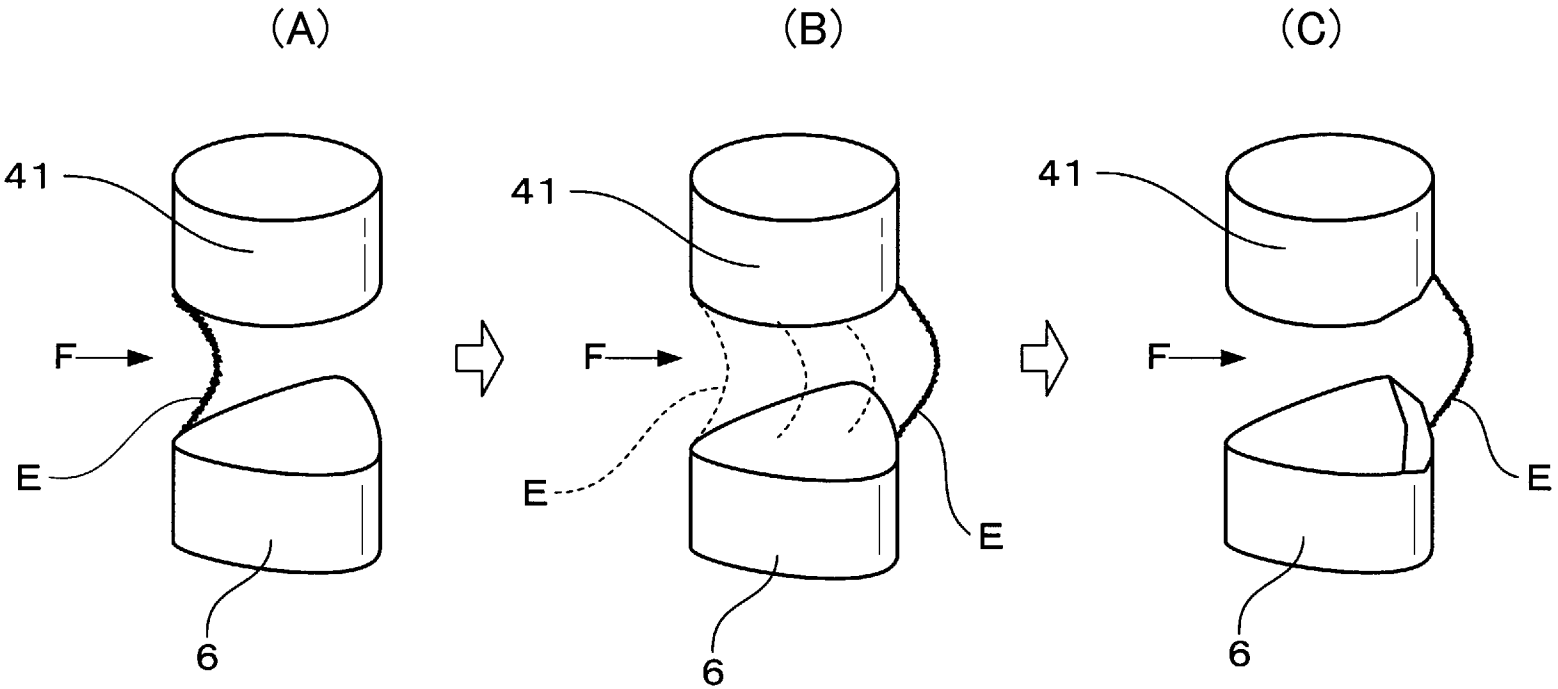
FIG. 8 is an explanatory view illustrating the projection portion according to the first embodiment, specifically showing by (A) a state of discharge, by (B) movement of spark discharge, and by (C) a state of disproportionate wear.

Referring to FIG. 8, hereinafter is specifically described a relationship between movement of a spark discharge E in the projection portion 6 and wear of the projection portion 6 when discharge is caused in the spark plug 1.

A predetermined voltage is applied across the center electrode 4 and the ground electrode 5 to cause discharge in the spark discharge gap 11. In the discharge, as shown in FIG. 8 by (A), the spark discharge E is initially obtained upstream in the projection portion 6. Specifically, the initial spark discharge E occurs in the minimum curvature radius portion 61 in which the field intensity is likely to be large. Then, as shown in FIG. 8 by (B), the spark discharge E drifts downstream by the flow F of the air-fuel mixture. Then, as shown in FIG. 8 by (C), the spark discharge E is blown and elongated at an edge portion downstream in the projection portion 6. During this period, the air-fuel mixture is ignited by the spark discharge E. Although the spark discharge E is blown, elongated and extinguished at the edge portion downstream in the projection portion 6, re-discharge is repeatedly caused at the same portion, i.e. the edge portion downstream in the projection portion 6. This is the cause of wear in the projection portion 6.

Referring to FIG. 4 and FIGS. 6 to 8, advantageous effects of the present embodiment will be described.

The projection portion 6 of the spark plug 1 has a cross section which is perpendicular to at least one axial direction of the plug and is in the specific shape. Specifically, as shown in FIG. 4, the area of the second region C in the cross section is ensured to be larger than the area of the first region B. In mounting the spark plug 1 to the combustion chamber 70 of the internal combustion engine 7, the first region B of the projection portion 6 is ensured to be located upstream of the second region C with respect to the flow F of the air-fuel mixture in the combustion chamber 70. Thus, the life of the spark plug 1 is lengthened. Specifically, with the above arrangement, the second region C having a larger area is located downstream in the flow F in the projection portion 6. Therefore, when re-discharge is repeatedly caused at the edge portion downstream in the projection portion 6 as mentioned above, the range of wear of the projection portion 6 due to the re-discharges is suppressed from expanding as shown in FIG. 8 by (C) according to the larger area. Thus, disproportionate wear of the projection portion 6 is minimized and wear resistance is enhanced. As a result, the life of the spark plug 1 is enhanced.

Further, with the above arrangement, the minimum curvature radius portion 61 of the first region B is located on an upstream side. Electric field is most likely to be concentrated in the vicinity of the minimum curvature radius portion 61 and thus the minimum curvature radius portion 61 is likely to serve as a start point of discharge. Therefore, by arranging the minimum curvature radius portion 61 on the upstream side, the spark discharge E can be initially obtained, as shown in FIG. 8 by (A), upstream in the projection portion 6. Then, as shown in FIG. 8 by (B), time is guaranteed before the spark discharge E drifts downstream and is blown off by the air-fuel mixture. Thus, an ignition opportunity for the flame (i.e., an opportunity for the ignition which leads to occurrence of the ignition) is well ensured. As a result, ignitability of the spark plug 1 is enhanced.

The configuration described above is realized by allowing the projection portion 6 to have the cross section in the specific shape. This also contributes to suppressing quenching action without the necessity of particularly increasing the diameter of the projection portion 6. As a result, ignitability of the spark plug 1 is prevented from being impaired.

Further, as shown in FIG. 7, the projection portion 6 is arranged such that the first straight line L1 will be perpendicular to the extending direction of the opposition portion of the ground electrode 5. Accordingly, the flow F that flows toward the spark discharge gap 11 is reliably prevented from being blocked by the ground electrode 5. At the same time, the second region C is ensured to be located downstream in the flow F and the first region B is ensured to be located upstream in the flow F. Therefore, as mentioned above, wear resistance of the projection portion 6 is enhanced, while ignition opportunity is well ensured. As a result, ignitability is more effectively enhanced, while the life of the spark plug 1 is enhanced.

The projection portion 6 is formed of a noble metal chip. Thus, the life of the spark plug 1 is further lengthened.

As described above, the present embodiment can provide a spark plug for an internal combustion engine, which is able to enhance ignitability and life of the spark plug, while suppressing quenching action, and can provide a mounting structure for the spark plug.

Second Embodiment

Figure 9:
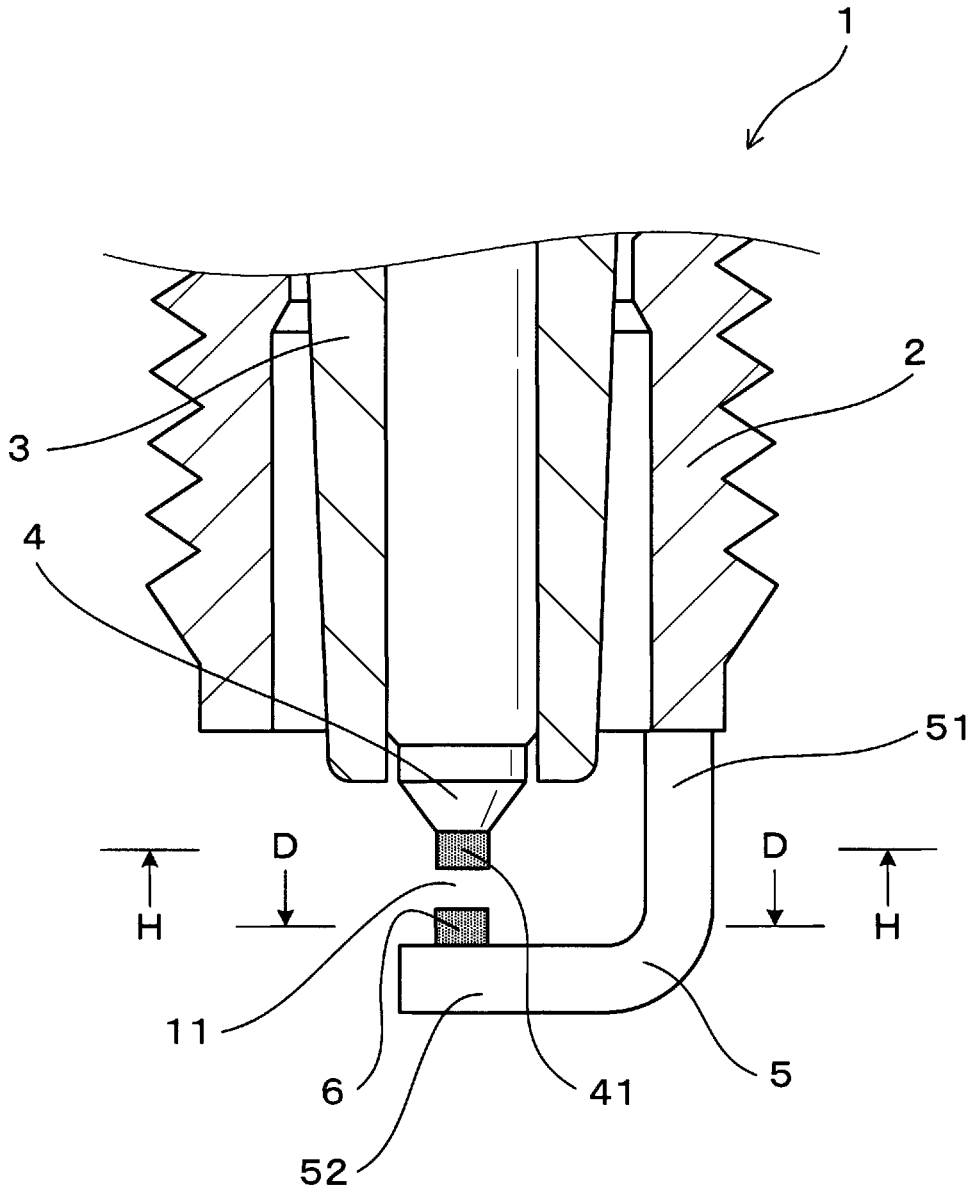
FIG. 9 is an explanatory view through a partial cross section of a spark plug, according to a second embodiment.
Figure 10:
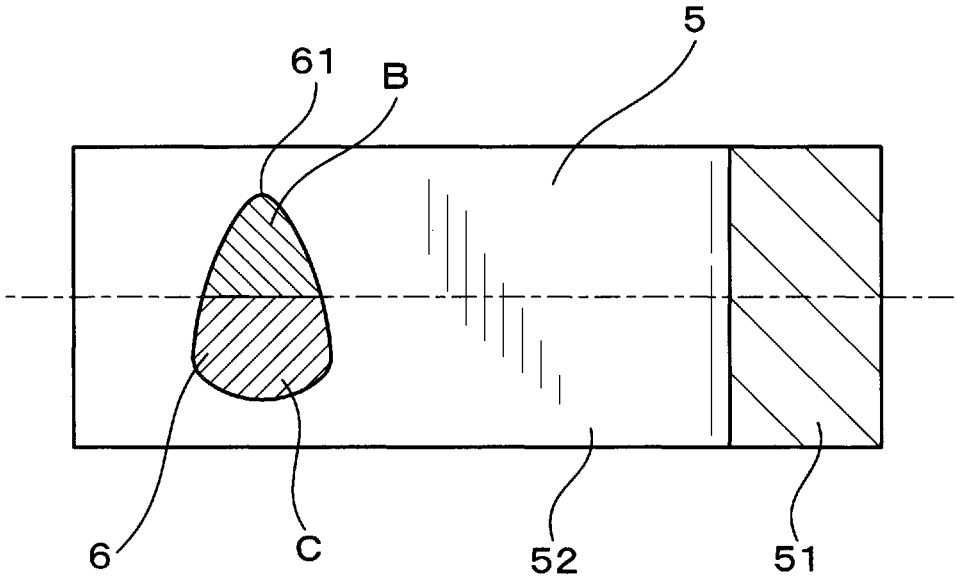
FIG. 10 is a cross-sectional view taken along a line D-D of FIG. 9.
Figure 11:
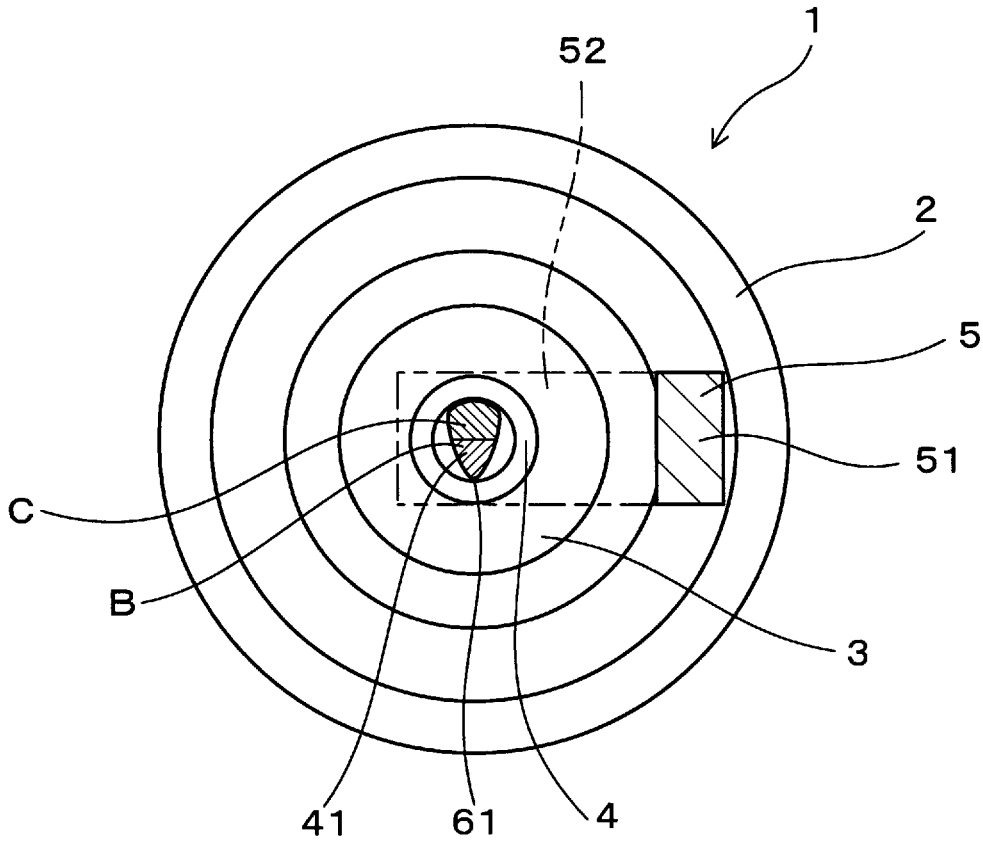
FIG. 11 is a cross-sectional view taken along a line H-H of FIG. 9.

As shown in FIGS. 9 to 11, in the present embodiment, the projection portion 41 provided at the tip portion of the center electrode 4 is also in the specific shape similar to the projection portion 6 of the ground electrode 5.

In the present embodiment, as shown in FIGS. 10 and 11, both of the projection portion 41 of the center electrode 4 and the projection portion 6 of the ground electrode 5 have a cross section perpendicular to the axial direction of the plug, the cross section being in the specific shape shown in the first embodiment (see FIG. 4).

In a state where the spark plug 1 of the present embodiment is mounted to the combustion chamber 70 of the internal combustion engine 7 (see FIG. 6), the first region B of each of the projection portion 41 and the projection portion 6 is located upstream of the second region C with respect to the flow F. At the same time, the minimum curvature radius portion 61 in each of the projection portions is oriented to an upstream side in the flow F.

The rest other than the above is similar to the first embodiment.

In the present embodiment, ignition opportunity is ensured, quenching action is suppressed and wear resistance is enhanced in the center electrode 4 as well similar to the ground electrode 5. Accordingly, ignitability and life of the spark plug 1 are effectively enhanced.

Other than the above, the advantageous effects similar to those of the first embodiment are obtained.

Third Embodiment

Figure 12:
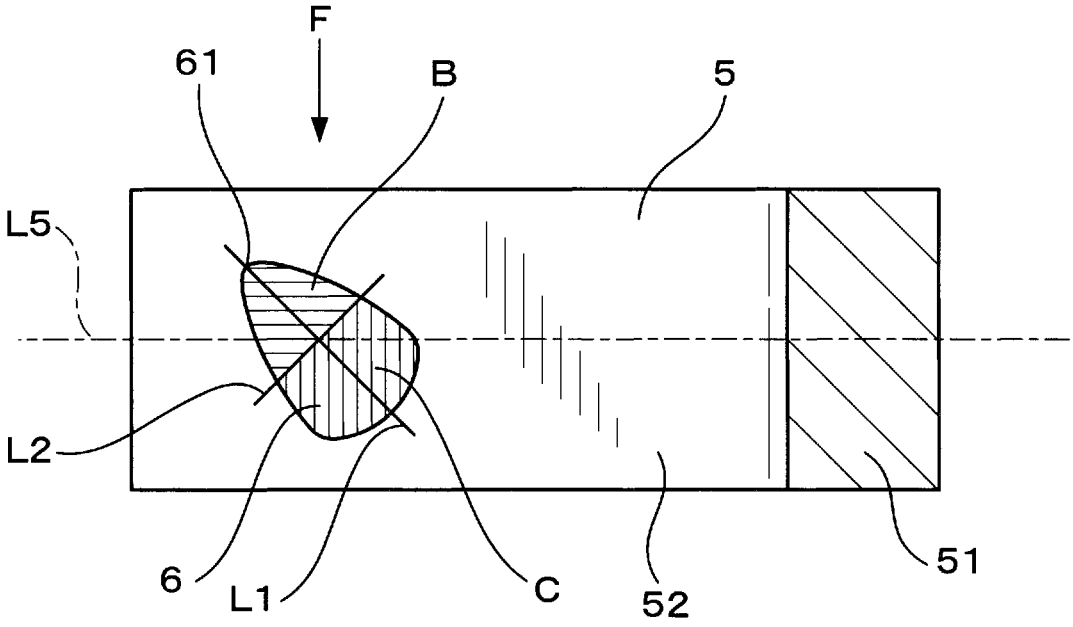
FIG. 12 is an explanatory view illustrating a projection portion according to a third embodiment, the view corresponding to FIG. 7.

As shown in FIG. 12, in the present embodiment, the projection portion 6 is arranged such that the first straight line L1 will obliquely intersect the extending direction of the opposing portion 52 of the electrode 5.

The projection portion 6 of the present embodiment is arranged such that the first straight line L1 intersects the extending direction of the opposing portion 52 (broken line L5) of the ground electrode 5 at an angle of 45°.

The rest other than the above is similar to the first embodiment.

As shown in FIG. 12, in the present embodiment as well, the flow F that flows toward the spark discharge gap 11 is prevented from being blocked by the ground electrode 5. At the same time, the second region C is ensured to be located downstream in the flow F and the first region B is ensured to be located upstream in the flow F. Specifically, for example, when the spark plug 1 is mounted to the combustion chamber 70 of the internal combustion engine 7 so that the extending direction of the opposing portion 52 (broken line L5) intersects the flow F, the minimum curvature radius portion 61 is ensured to be located upstream in the flow F. Accordingly, as mentioned above, wear resistance of the projection portion 6 is enhanced, while ignition opportunity is well ensured. As a result, while the life of the spark plug 1 is enhanced, ignitability is further enhanced.

Other than the above, the advantageous effects similar to those of the first embodiment are obtained.

Fourth Embodiment

Figure 13:
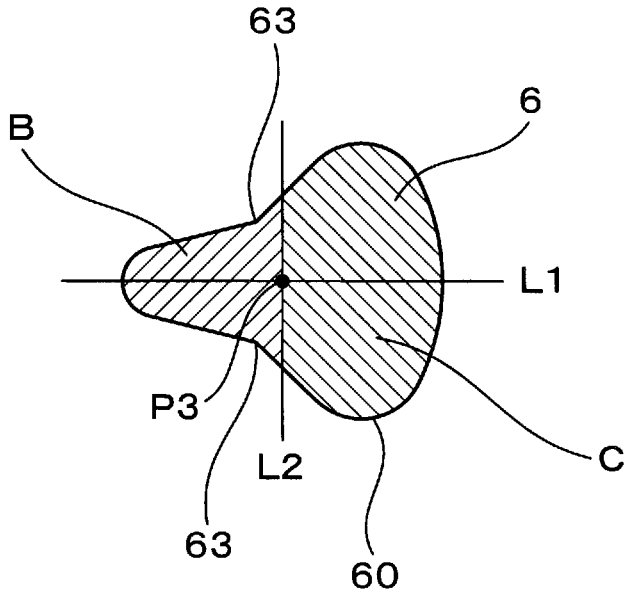
FIG. 13 is an explanatory view illustrating a projection portion according to a fourth embodiment, specifically showing by (A) a cross section corresponding to FIG. 4, and by (B) a perspective corresponding to FIG. 5.
Figure 13:
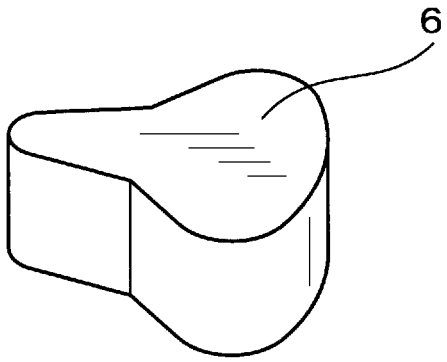

As shown in FIG. 13 by (A) and (B), in the present embodiment, the projection portion 6 in the specific shape is formed in such a way that the difference in area between the first region B and the second region will be larger.

In the projection portion 6 of the present embodiment, the contour 60 of a cross section perpendicular to the axial direction of the plug has recessed portions 63 which are recessed toward the midpoint P3 of the first line segment M. Each recessed portion 63 is formed in a part of the contour 60 of the cross section, extending from the minimum curvature radius portion 61 in the first region B to a part of the second region C. Thus, as shown in FIG. 13 by (A), in the cross section of the projection portion 6, which is perpendicular to the axial direction of the plug, the area of the first region B is made particularly smaller than the area of the second region C, so that the difference in area will be larger.

The rest other than the above is similar to the first embodiment.

In the projection portion 6 of the present embodiment, electric field is easily concentrated on the first region B side that includes the minimum curvature radius portion 61 and thus the minimum curvature radius portion 61 is easily permitted to serve as a start point of discharge. Thus, ignition opportunity is easily ensured. Further, wear resistance on the second region C side is more easily enhanced. As a result, ignitability and life of the spark plug 1 are effectively enhanced.

Other than the above, the advantageous effects similar to those of the first embodiment are obtained.

Fifth Embodiment

Figure 14:
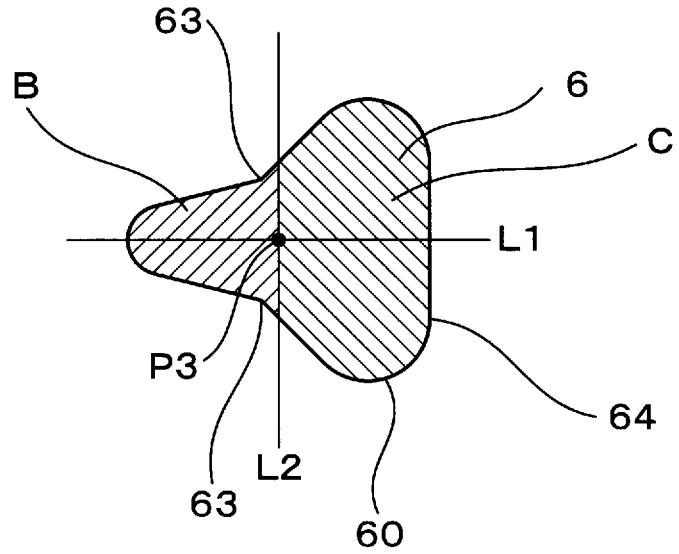
FIG. 14 is an explanatory view illustrating a projection portion according to a fifth embodiment, specifically showing by (A) a cross section corresponding to FIG. 4, and by (B) a perspective corresponding to FIG. 5.
Figure 14:
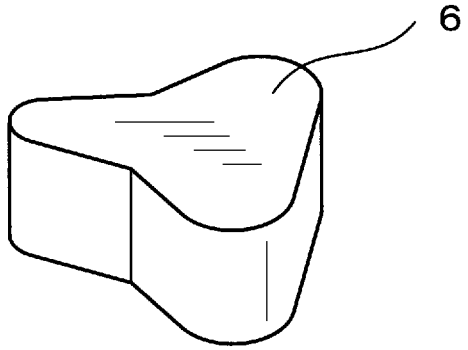

As shown in FIG. 14 by (A) and (B), in the present embodiment as well, the contour 60 of the projection portion 6 in the specific shape is provided with the recessed portions 63 to increase the difference in area between the first region B and the second region C.

Further, in the present embodiment, the contour 60 of the second region C in the cross section of the projection portion 6 is partially provided with a straight portion 64 that is perpendicular to the first straight line L1.

The rest other than the above is similar to the fourth embodiment and thus the advantageous effects similar to those of the first embodiment are obtained.

Comparative Example 1

Figure 1:
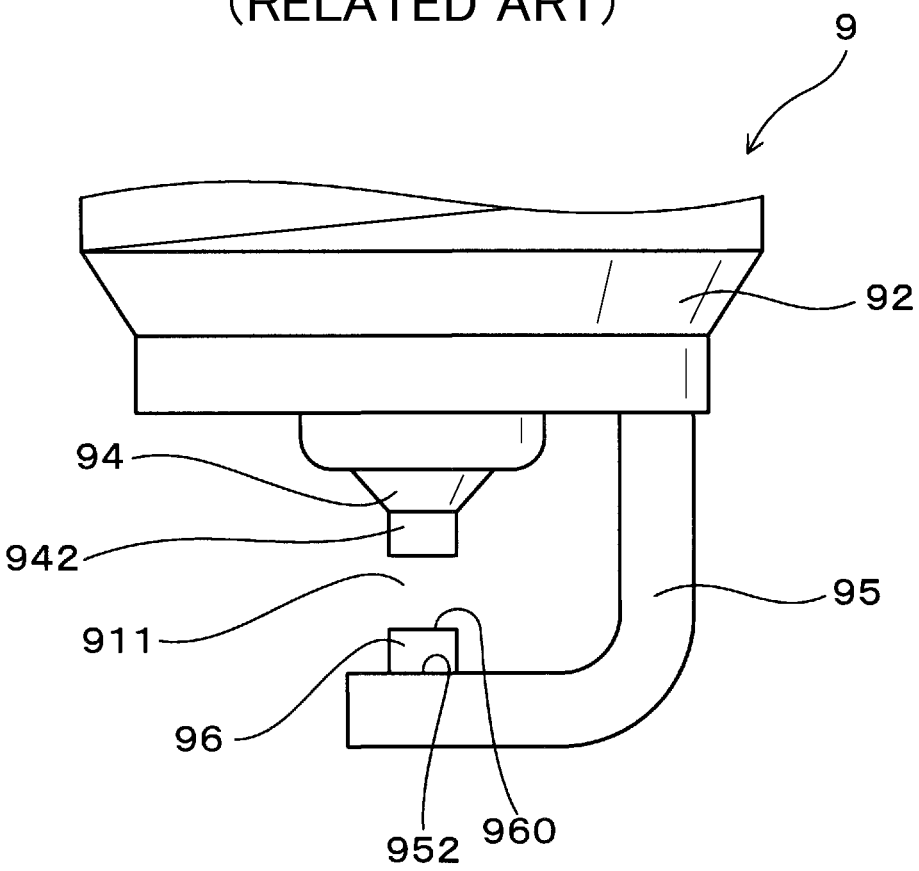
FIG.1 (RELATED ART)
FIG. 1 is an explanatory view illustrating a tip portion of a spark plug in a background art.
Figure 2:
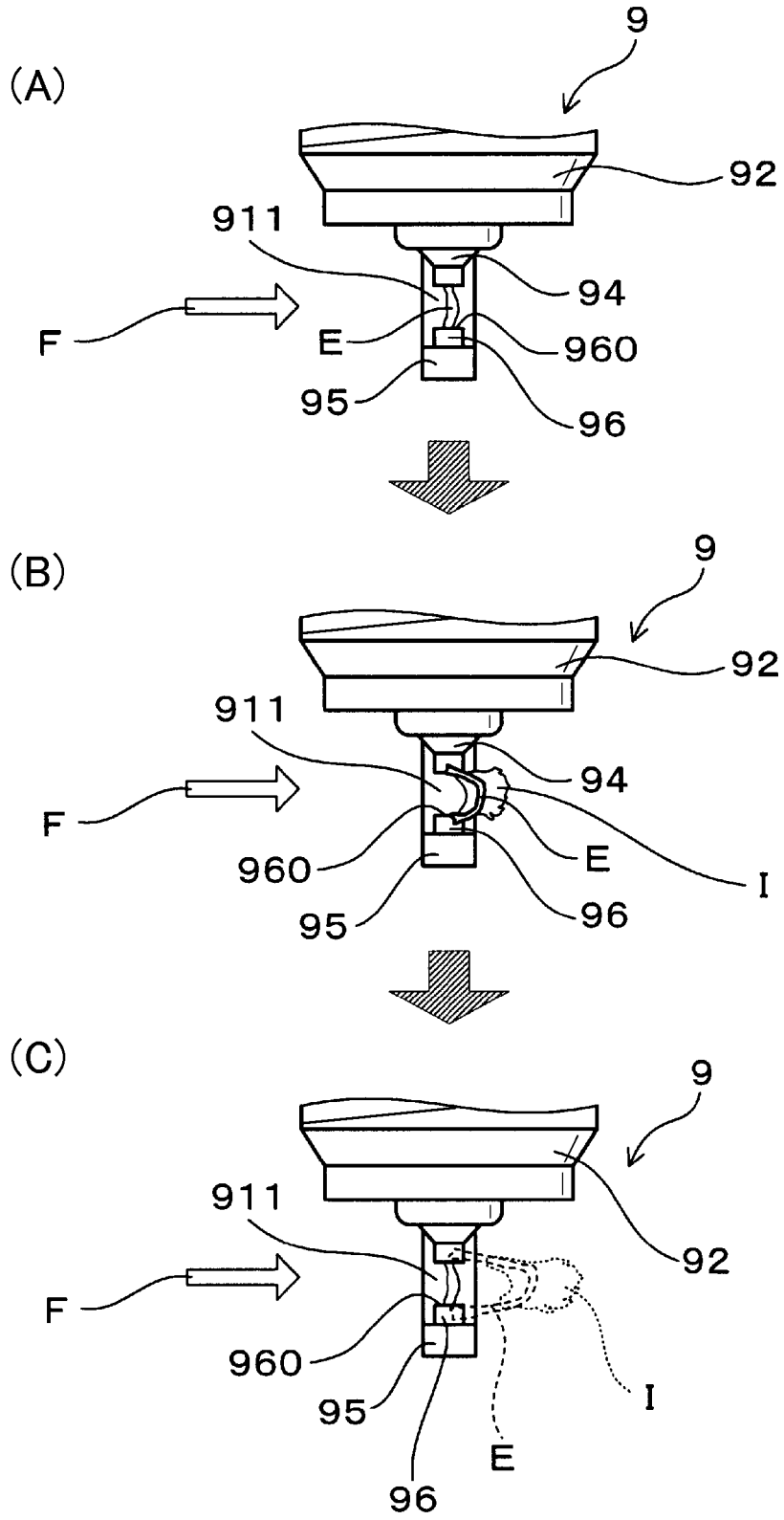
FIG.2 (RELATED ART)
FIG. 2 is an explanatory view illustrating the tip portion of the spark plug in the background art, specifically showing by (A) a state of discharge, by (B) a state where a discharge spark is blown and elongated by a gas flow, and by (C) a state where the discharge is cut.
Figure 15:
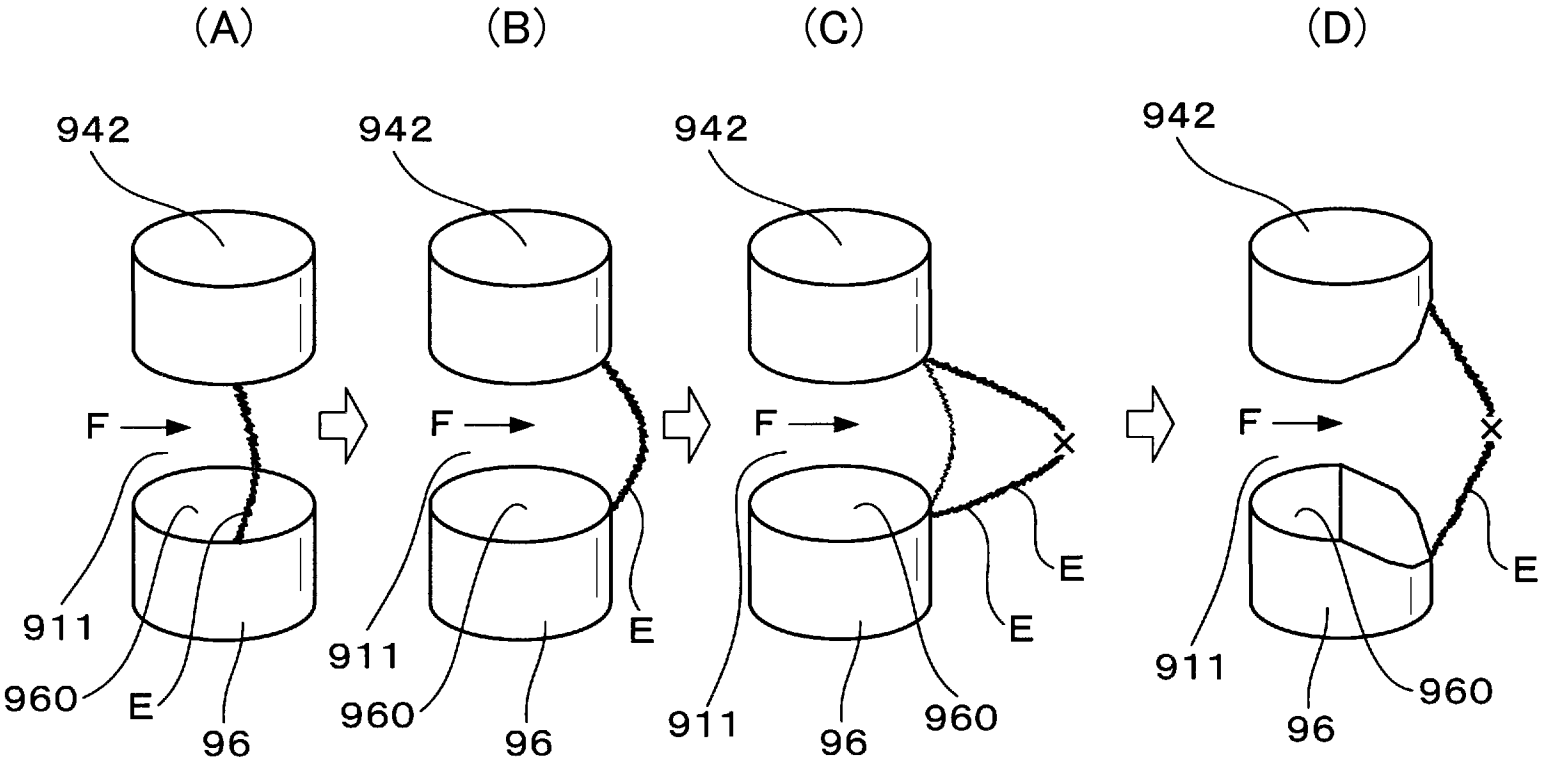
FIG. 15 is an explanatory view illustrating a projection portion in a spark plug, according Comparative Example 1, specifically showing by (A) a state of discharge, by (B) movement of spark discharge, by (C) blow-out of spark discharge and re-discharge, and by (D) a state of disproportionate wear.

As shown in FIGS. 15, 1 and 2, in the present example, the spark plug 9 has the ground electrode 95 provided with the projection portion 96 in a pillar shape.

As shown in FIG. 1, the spark plug 9 of the present example is configured by arranging the projection portion 96 and the projection portion 942 to both of the tip portion of the center electrode 94 and the opposing portion 952 of the ground electrode 95. The projections 96 and 942 are projected toward the spark discharge gap 911 and are in substantially a pillar shape.

The rest other than the above is similar to the first embodiment.

When the spark plug 9 is used, i.e. when discharge is caused, being mounted to an internal combustion engine, the spark discharge E is initially generated, as shown in FIG. 15 by (A), at some portion in the edge portion of the projected portion 96. However, the position of the initial spark discharge is not particularly specified and is not necessarily upstream in the direction of the flow F. Accordingly, depending on the position at which an initial discharge is caused, time is likely to be short before the discharge spark E drifts downstream by the air-fuel mixture and blown off, and thus ignition opportunities are reduced. Then, as shown in FIG. 15 by (B), the discharge spark E drifts downstream in the projection portion 96 by the flow F. Then, as shown in FIG. 15 by (C), the discharge spark E is expanded and extinguished before the air-fuel mixture is heated by the discharge spark E in the spark discharge gap 911. Then, at the same portion, i.e. at the edge portion 966 downstream in the projection portion 96, re-discharge is repeatedly caused. Therefore, as shown in FIG. 15 by (D), disproportionate wear occurs in the edge portion 966 downstream in the projection portion 96. As a result, the life of the spark plug 9 is shortened.

Experimental Example 1

Figure 16:
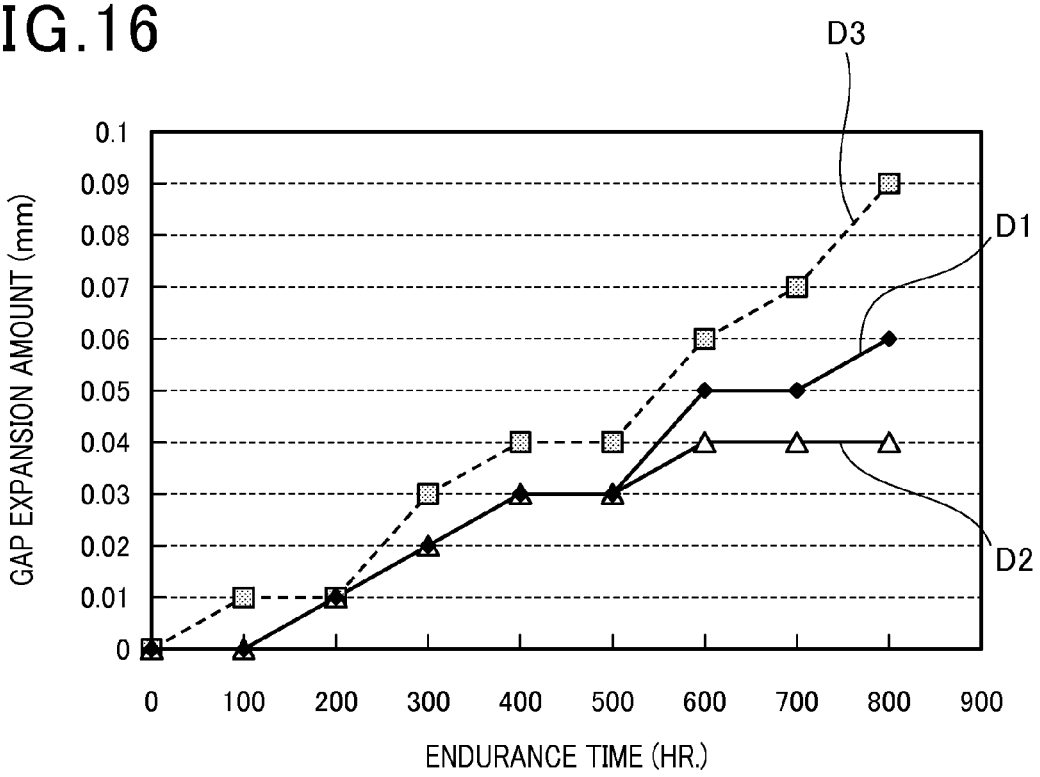
FIG. 16 is a diagram illustrating a relationship between endurance time and gap expansion amount, according to Experimental Example 1.

As shown in FIG. 16, in the present example, wear resistance was researched for the projection portion of a spark plug, by measuring the amount of expansion of the spark discharge gap (hereinafter, this is adequately referred to as gap expansion amount).

As targets of evaluation, "Specimen 1" of the spark plug 1 of the first embodiment was prepared, in which the projection portion in the specific shape was arranged only at the ground electrode 5. Further, "Specimen 2" of the spark plug 1 of the second embodiment was prepared, in which the projection portion 6 and the projection portion 41 in the specific shape were arranged at both of the center electrode 4 and the ground electrode 5. Also, "Specimen 3" of the spark plug 9 shown in Comparative Example 1 was prepared, in which the projection portion 96 and the projection portion 942 in a pillar shape were arranged at both of the center electrode 94 and the ground electrode 95. Three sample spark plugs were prepared for each of Specimens 1 to 3.

The diameter of the projection portion of Specimen 3 was 0.7 mm.

In Specimens 1 to 3, the projection portions, including those on the center electrode side and the ground electrode side, were permitted to have a cross section perpendicular to the axial direction of the plug with substantially an even cross-sectional area. Also, the amount of material in use is substantially the same between the projection portions.

In each of the specimens, the projection portion on the center electrode side is made of an iridium alloy, and the projection portion on the ground electrode side is made of a platinum alloy.

Using these specimens, the following endurance test was conducted.

In performing the endurance test, the specimen spark plugs were loaded on a testing device that resembles to the combustion chamber 70, creating a nitrogen atmosphere in the device at a pressure of 0.6 MPa.

Further, an air-fuel mixture was sent into the device so as to form a flow at a flow speed of 30 m/sec in the vicinity of the tip portion of each spark plug, and a voltage was applied to each spark plug at a discharge cycle of 30 Hz. Ignition energy in this instance was 70 mJ.

Each spark plug, when loaded on the device, was in a posture in which the vertical portion of the ground electrode (see reference 51 of FIG. 3) was located at a position that allows the vertical portion to be perpendicular to the direction of the gas flow.

FIG. 16 shows the results of the endurance test. In the figure, the line graph connecting rhombic plots assigned with a reference D1 shows measurement results of Specimen 1, while the line graph connecting triangular plots assigned with a reference D2 shows measurement results of Specimen 2. Further, the line graph connecting rectangular plots assigned with a reference D3 shows measurement results of Specimen 3. Each measurement value reflects an average value of the actual measurement values of the three samples of each specimen.

The vertical axis of the graphs shown in the figure indicates gap expansion amount (mm), and the horizontal axis indicates endurance time (hours).

As will be understood from FIG. 16, the spark discharge gap is gradually expanded in all of the specimens with passage of the endurance time. Comparing with Specimen 3 (D3), the rate of increase of the gap expansion amount is low in Specimen 1 (D1) and Specimen 2 (D2). Specifically, it will be understood that Specimens 1 and 2 have better wear resistance in the projection portions against spark discharges.

Further, when the endurance time becomes 600 hours or more, the gap expansion amount of Specimen 2, in particular, hardly increases and hence Specimen 2 has better durability than Specimen 1. Specifically, the expansion of the spark discharge gap is further suppressed by providing the projection portion in the specific shape to both of the center electrode and the ground electrode.

Experimental Example 2

Figure 17:
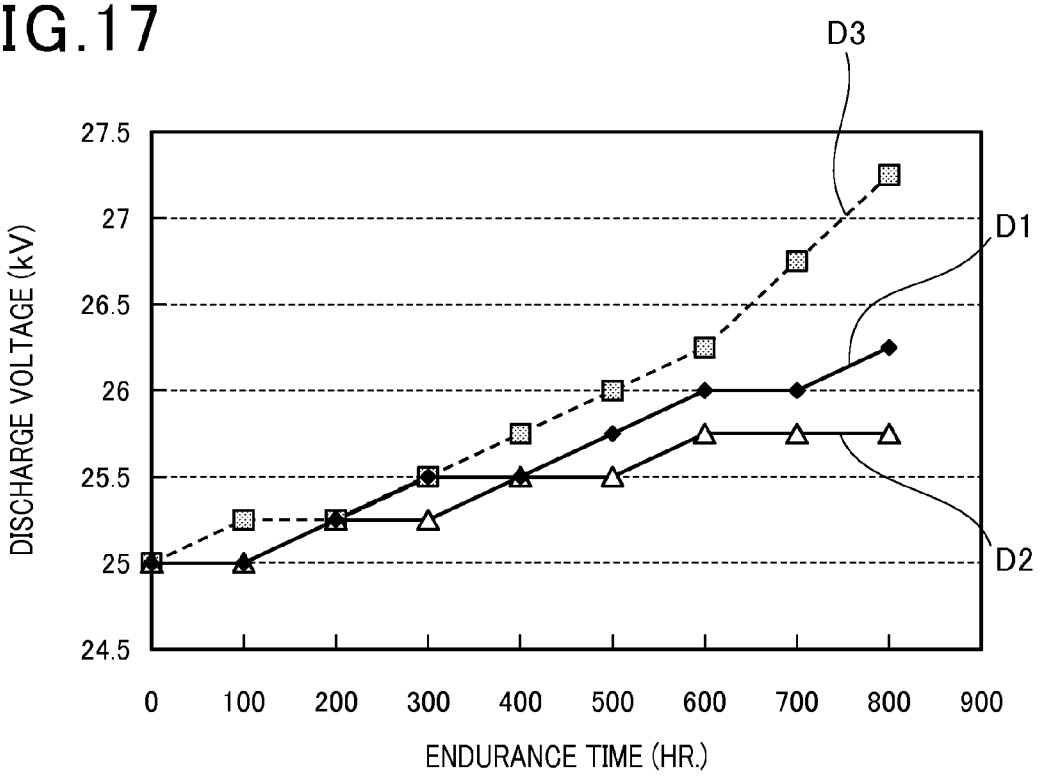
FIG. 17 is a diagram illustrating a relationship between endurance time and discharge voltage, according to Experimental Example 2.

As shown in FIG. 17, in the present example, wear resistance is researched for the projection portion of a spark plug, by measuring discharge voltage.

In general, discharge voltage increases with the expansion of the spark discharge gap. In this regard, in the endurance test of the present example, the voltage of each spark discharge was measured to confirm whether the increase of the discharge voltage of the spark plugs according to the first and second embodiments was suppressed compared to that of the comparative example.

In the present example, the method of endurance test and conditions of the targets of evaluation (Specimens 1 to 3) are the same as those of Experimental Example 1.

For each specimen, discharge voltage of each of 1000 spark discharges was measured for every lapse of 100 hours of endurance time. In the measurements, the maximum values of the discharge voltages were measured for the three samples of each specimen and the three maximum values were averaged as shown in the plots of FIG. 17.

FIG. 17 shows the results of the measurements. In the figure, the line graph connecting rhombic plots assigned with a reference D1 shows measurement results of Specimen 1, while the line graph connecting triangular plots assigned with a reference D2 shows measurement results of Specimen 2. Further, the line graph connecting rectangular plots assigned with a reference D3 shows measurement results of Specimen 3.

The vertical axis of the graphs shown in the figure indicates discharge voltage (kV), and the horizontal axis indicates endurance time (hours).

As will be understood from FIG. 17, the discharge voltage gradually increases in all of the specimens with passage of the endurance time. Comparing with Specimen 3 (D3), the rate of increase of the discharge voltage is low in Specimen 1 (D1) and Specimen 2 (D2). Specifically, it will be understood that Specimens 1 and 2 have better wear resistance in the projection portions against spark discharges. Further, when the endurance time becomes 500 hours or more, the discharge voltage of Specimen 2, in particular, hardly increases and hence Specimen 2 has better durability than Specimen 1. Specifically, the increase of discharge voltage is further suppressed by providing the projection portion in the specific shape to both of the center electrode and the ground electrode.

Experimental Example 3

Figure 18:
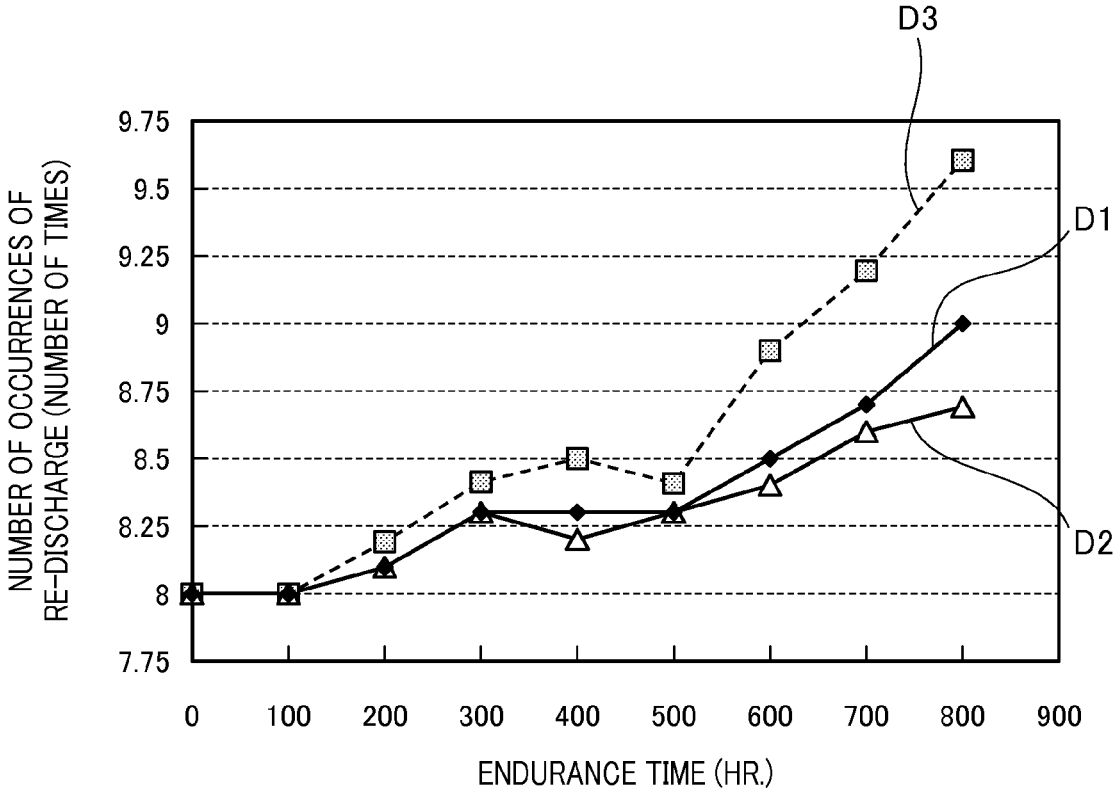
FIG. 18 is a diagram illustrating a relationship between endurance time and the number of occurrences of re-discharge.

As shown in FIG. 18, in the present example, wear resistance of a spark plug is researched, by measuring the number of occurrences of re-discharge.

Specifically, in the present example, the number of re-discharges was measured for each specimen to confirm whether the increase of the number of occurrences of re-discharge in the spark plugs according to the first and second embodiments is suppressed compared to that of the comparative example.

In the present example, the method of endurance test and conditions of the targets of evaluation (Specimens 1 to 3) are the same as those of Experimental Example 1.

For each specimen, the waveform of discharge voltage of each of 10 spark discharges was measured for every lapse of 100 hours of endurance time, using a high-frequency probe, and the number of occurrences of re-discharge was researched. The measurements were conducted by observing the waveform of electric current in every voltage application and counting the number of times for the electric current value to exceed a predetermined threshold.

Each plot shown in FIG. 18 indicates an average of the numbers of occurrences of re-discharge in the three samples of each specimen.

FIG. 18 shows the results of the measurements in detail. In the figure, the line graph connecting rhombic plots assigned with a reference D1 shows measurement results of Specimen 1, while the line graph connecting triangular plots assigned with a reference D2 shows measurement results of Specimen 2. Further, the line graph connecting rectangular plots assigned with a reference D3 shows measurement results of Specimen 3.

The vertical axis of the graphs shown in the figure indicates number of occurrences of re-discharge (number of times), and the horizontal axis indicates endurance time (hours).

As will be understood from FIG. 18, the number of occurrences of re-discharge gradually increases in all of the specimens with passage of the endurance time. Comparing with Specimen 3 (D3), the rate of increase of the number of occurrences of re-discharge is low in Specimen 1 (D1) and Specimen 2 (D2). Specifically, it was confirmed that the number of re-discharges was suppressed as well in the spark plugs of the first and second embodiments. Further, when the endurance time becomes 600 hours or more, the number of occurrences of re-discharge in Specimen 2, in particular, hardly increases. In other words, it can be said that the increase in the number of occurrences of re-discharge is further suppressed by providing a projection portion in the specific shape to both of the center electrode and the ground electrode.

In the configurations of the foregoing several embodiments, the projection portion in the specific shape may be arranged at either one of the center electrode and the ground electrode, or may be arranged at both of the center electrode and the ground electrode. When the projection portion is arranged at the center electrode, the projection portion is formed such that the width thereof in the radial direction of the plug will be smaller than the outer diameter of the tip portion of the center electrode.

DESCRIPTION OF SYMBOLS

1 Spark plug
2 Housing

3 Insulation porcelain
4 Center electrode
5 Ground electrode
52 Opposing portion
6 Projection portion
61 Minimum curvature radius portion
L1 First straight line
M First line segment
L2 Second straight line
B First region
C Second region

What is claimed is:

1. A spark plug for an internal combustion engine, the spark plug comprising a cylindrical housing, a cylindrical insulation porcelain held inside the housing, a center electrode held inside the insulation porcelain, with a tip portion thereof being projected, and a ground electrode connected to the housing and having an opposing portion opposed to the center electrode in an axial direction of the plug to form a spark discharge gap between the center electrode and the ground electrode, wherein at least one of the tip portion of the center electrode and the opposing portion of the ground electrode has a projection portion projected toward the spark discharge gap; and at least one of the projection portions:

i) has a cross section perpendicular to the axial direction of the spark plug, the cross section including a minimum curvature radius portion having a smallest curvature radius in a contour of the cross section; and ii) is in a specific shape that meets a requirement, the requirement being that, when a first straight line is supposed to connect between the minimum curvature radius portion and a geometric centroid in the cross section, a first line segment is supposed to connect between two intersections at which the first straight line intersects the contour of the cross section, and a second straight line is supposed to be perpendicular to the first line segment at a midpoint in the first line segment, and when the cross section is divided by the second straight line into a first region that includes the minimum curvature radius portion and a second region that does not include the minimum curvature radius portion, the second region has an area larger than an area of the first region.

2. The spark plug for an internal combustion engine according to claim 1, wherein the projection portion is arranged at both of the tip portion of the center electrode and the opposing portion of the ground electrode, and the projection portion of the both has a cross section that is in the specific shape.

3. The spark plug for an internal combustion engine according to claim 2, wherein the projection portion is arranged so that the first straight line intersects an extending direction of the opposing portion of the ground electrode.

4. The spark plug for an internal combustion engine according to claim 3, characterized in that the projection portion is arranged so that the first straight line is perpendicular to an extending direction of the opposing portion of the ground electrode.

5. The spark plug for an internal combustion engine according to claim 4, wherein the projection portion is formed of a noble metal chip.

6. The spark plug for an internal combustion engine according to claim 1, wherein the projection portion is arranged so that the first straight line intersects an extending direction of the opposing portion of the ground electrode.

7. The spark plug for an internal combustion engine according to claim 6, characterized in that the projection portion is arranged so that the first straight line is perpendicular to an extending direction of the opposing portion of the ground electrode.

8. The spark plug for an internal combustion engine according to claim 7, wherein the projection portion is formed of a noble metal chip.

9. The spark plug for an internal combustion engine according to claim 1, characterized in that the projection portion is arranged so that the first straight line is perpendicular to an extending direction of the opposing portion of the ground electrode.

10. The spark plug for an internal combustion engine according to claim 9, wherein the projection portion is formed of a noble metal chip.

11. The spark plug for an internal combustion engine according to claim 1, wherein the projection portion is formed of a noble metal chip.

12. A mounting structure for a spark plug mounted to an internal combustion engine, the spark plug comprising: a cylindrical housing, a cylindrical insulation porcelain held inside the housing, a center electrode held inside the insulation porcelain, with a tip portion thereof being projected, and a ground electrode connected to the housing and having an opposing portion opposed to the center electrode in an axial direction of the plug to form a spark discharge gap between the center electrode and the ground electrode, wherein at least one of the tip portion of the center electrode and the opposing portion of the ground electrode has a projection portion projected toward the spark discharge gap; and at least one of the projection portions:

i) has a cross section perpendicular to the axial direction of the spark plug, the cross section including a minimum curvature radius portion having a smallest curvature radius in a contour of the cross section; and ii) is in a specific shape that meets a requirement, the requirement being that, when a first straight line is supposed to connect between the minimum curvature radius portion and a geometric centroid in the cross section, a first line segment is supposed to connect between two intersections at which the first straight line intersects the contour of the cross section, and a second straight line is supposed to be perpendicular to the first line segment at a midpoint in the first line segment, and when the cross section is divided by the second straight line into a first region that includes the minimum curvature radius portion and a second region that does not include the minimum curvature radius portion, the second region has an area larger than an area of the first region, and wherein the mounting structure is structured such that the projection portion located in a combustion chamber of the engine is arranged so that the first region is located upstream of the second region with respect to a flow of an air-fuel mixture supplied to the combustion chamber.

* * * * *